United States Patent [19]

Towne et al.

[11] Patent Number: 4,635,316

[45] Date of Patent: Jan. 13, 1987

[54] METHODS AND APPARATUS FOR PERFORATING FOOD CASING FILM AND CASING PRODUCED THEREBY

[75] Inventors: Clinton G. Towne, Danville; Thomas R. Stanley, Downers Grove, both of Ill.

[73] Assignee: Teepak, Inc., Oak Brook, Ill.

[21] Appl. No.: 749,345

[22] Filed: Jun. 26, 1985

[51] Int. Cl.[4] ..... B26D 3/00

[52] U.S. Cl. ..... 17/1 R; 83/37; 83/308; 83/339; 83/660; 83/678; 138/118.1; 17/42

[58] Field of Search ..... 83/37, 38, 30, 678, 83/345, 339, 308, 660, 332; 17/1 R, 42; 138/118.1

[56] References Cited

U.S. PATENT DOCUMENTS

| | | | |
|---|---|---|---|
| 94,333 | 8/1869 | Nesmith | 83/345 |
| 118,327 | 8/1871 | Arkell | 83/339 X |
| 1,937,499 | 12/1933 | Adams | 83/339 |
| 2,081,280 | 5/1937 | Pearl | 83/339 |
| 2,608,488 | 8/1952 | Rumsey | 138/118.1 |
| 3,120,777 | 2/1964 | Genin | 83/339 X |
| 3,126,777 | 3/1964 | Shabram | 83/174 |
| 3,142,216 | 7/1964 | Rupnow | 83/308 |
| 3,546,742 | 12/1970 | Kugler | 83/660 X |
| 3,562,368 | 2/1971 | Bridgeford | 264/36 |
| 3,669,791 | 6/1972 | Bridgeford | 156/244 |
| 3,682,028 | 8/1972 | Clayton et al. | 83/660 X |
| 3,738,209 | 6/1973 | Davis | 83/98 |
| 3,760,671 | 9/1973 | Jenkins | 83/155 |
| 3,779,285 | 12/1973 | Sinibaldo | 138/118.1 |
| 3,834,969 | 9/1974 | Doll | 156/466 |
| 3,969,458 | 7/1976 | Hunter | 264/154 |

FOREIGN PATENT DOCUMENTS

| | | | |
|---|---|---|---|
| 1497723 | 9/1967 | France | 83/332 |
| 8308252 | 6/1983 | Spain . | |
| 451489 | 5/1968 | Switzerland | 83/660 |

*Primary Examiner*—James M. Meister

*Attorney, Agent, or Firm*—Michael L. Dunn; Howard M. Ellis

[57] ABSTRACT

Prestuck food casing films are made with an apparatus having a perforating roll with multiple knife blades. The perforating roll is linked to a power roll so the casing being pulled through the apparatus drives the power roll which turns the perforating roll to perforate the film. The power roll and the perforating roll turn at the same peripheral speed so any change in velocity of the advancing film automatically adjusts the speed of the perforating roll eliminating tears or enlargement of perforations.

31 Claims, 9 Drawing Figures

93
16
23
25
74
70
104
81
67
78
95
44
95
75
16
76
108
96
36
102
50
42
97
G
18
21
G 109
75
103
106
108
103

108
106
103

108
109
106
103

88
101
42
36
108
97
94
36
96
94
44
107
108
101

METHODS AND APPARATUS FOR PERFORATING FOOD CASING FILM AND CASING PRODUCED THEREBY

BACKGROUND OF THE INVENTION

The present invention relates to films used in packaging food products, and more particularly, to methods and apparatus for making perforated tubular food casings used in processing and packaging meat and sausage products.

It has been common practice to prepare both edible and nonedible webs of tubular food casings for use in the meat packing industry. The nonedible type casings, particularly those fabricated from stronger fibrous reinforced films are especially useful in packaging whole hams, ham butts, picnics as well as bolognas and other larger size sausage and meat products. Generally, fibrous reinforced films are prepared by saturating a paper or other tubular web with a continuous matrix of a film forming polymer, like viscose which is then regenerated, washed, plasticized and dried. As part of the final manufacturing process fibrous food casings are frequently prestuck by perforating with either multiple needle or circular punch size holes which allow venting of the casing during stuffing operations. Generally, perforations provide for shorter stuffing cycles since air can be more readily discharged through the casing sidewall. The perforations also operate to enhance and facilitate drainage of any water, fat or jelly pockets which might otherwise form during or after processing of the meat product.

Although prestuck food casings are well established in the industry, previous methods and equipment for their manufacture have not been totally satisfactory. Heretofore, food films were perforated, for example, with multiple needle-like or flat faced, sharp edged punches mounted circumferentially over the face of a roll, such as described in U.S. Pat. Nos. 3,779,285; 3,126,777 and 3,760,671. In each case, the perforating roll interfaces with a counter-rotating backup roll having a resilient, but substantially solid surface free of complimentary grooves on its outer coverings. Consequently, the punches, needles, etc., perforate by initially compressing the film against the solid surface of the backup roll. This has a tendency to form perforations with frayed or uneven edges which may result in tubular film having an unacceptably high incidence of rupturing. Furthermore, after the film is perforated the needles or punches then make contact with the backup roll reducing their useful life expectancies.

In manufacturing prestuck food films the size and shape of the perforations can be critical. For instance, food casings having vent holes which are either undersized, flared or have frayed edges experience statistically higher failure rates from rupturing during stuffing. Offsetting this problem usually means slower stuffing cycles due to extended venting times. In addition, poor drainage can occur with undersized perforations leading to unappetizing fatty-gel deposits developing between the outer surface of the product and the inner sidewall of the casing. Similar undesirable results can also arise when perforations are oversized, in which case meat emulsion and desirable natural juices can be lost from the package.

In addition to the foregoing, conventional methods of presticking newer premoisturized, ready-to-stuff fibrous casings, which eliminate the need for soaking before filling, do not provide consistently acceptable results. It has been found that presticking premoisturized type casings using known perforating methods, such as needles or punches in some instances form oversized, off-spec perforations or holes with flared edges. Such deviations in the dimensions of perforations in prestuck films can occur through variations in film velocity and lack of synchronization between the film speed through the presticker apparatus and velocity of the perforating rollers occurring, for instance, during start-up and shutdown of the production line. That is, even small variations in film speed or perforation roll velocity can result in off-spec or even torn film. Similar problems may also occur with enlarged perforations with initial entry of the perforating device into the film where the needle or punch pivots in an arc and expands the size of the hole when exiting the perforation. Accordingly, there is a need for improved methods and apparatus for making prestuck food casing with more uniform size holes and with minimal tearing of the film.

SUMMARY OF THE INVENTION

It has been found that prestuck food casing films can be prepared with greater control over the dimensions of perforations using the improved methods and apparatus of the present invention. The casing/workpiece being pulled through the apparatus provides the mechanical energy for operating the device to perforate the film with multiple small punctures, slits, etc. The perforations are formed by a rotatable perforating roll having multiple knife blades, etc., linked to and driven by a rotatable drive roll which turns the perforating roll at the same or substantially the same velocity as the drive roll. The apparatus is actuated by engaging the perforating roll and the drive roll with the film and advancing the film causing the drive roll to rotate and the blades to perforate the film.

The perforating blades, etc., radially projecting from the surface of the perforating roll cooperate with a backup roll so as to enter a complimentary arrangement of slits or voids in the backup roll after perforating the casing so the blades avoid making contact with the backup roll, thereby providing more efficient means for perforating the film and for cleaner, more uniform perforations which means tubular film with greater reliability, as well as extended life expectancy of the blades, etc., and backup roll.

A further aspect of the invention includes the use of multiple spaced knife blades radially mounted on the perforating roll. The blades preferably have a slanted or beveled cutting edge at their outermost terminal ends where the farthest extending point of each blade edge making contact with the film provides a piercing action followed by a slitting action as the balance of the blade edge penetrates through the film as the perforating roll turns. The slanted cutting edge minimizes flared, frayed or uneven perforations, as well as oversized perforations.

BRIEF DESCRIPTION OF THE DRAWINGS

For a further understanding of the invention as well as its characterizing features, reference should now be made to the following detailed description thereof taken in conjunction with the accompanying drawings, wherein.

DESCRIPTION OF PREFERRED EMBODIMENTS

Figures 1, 2:
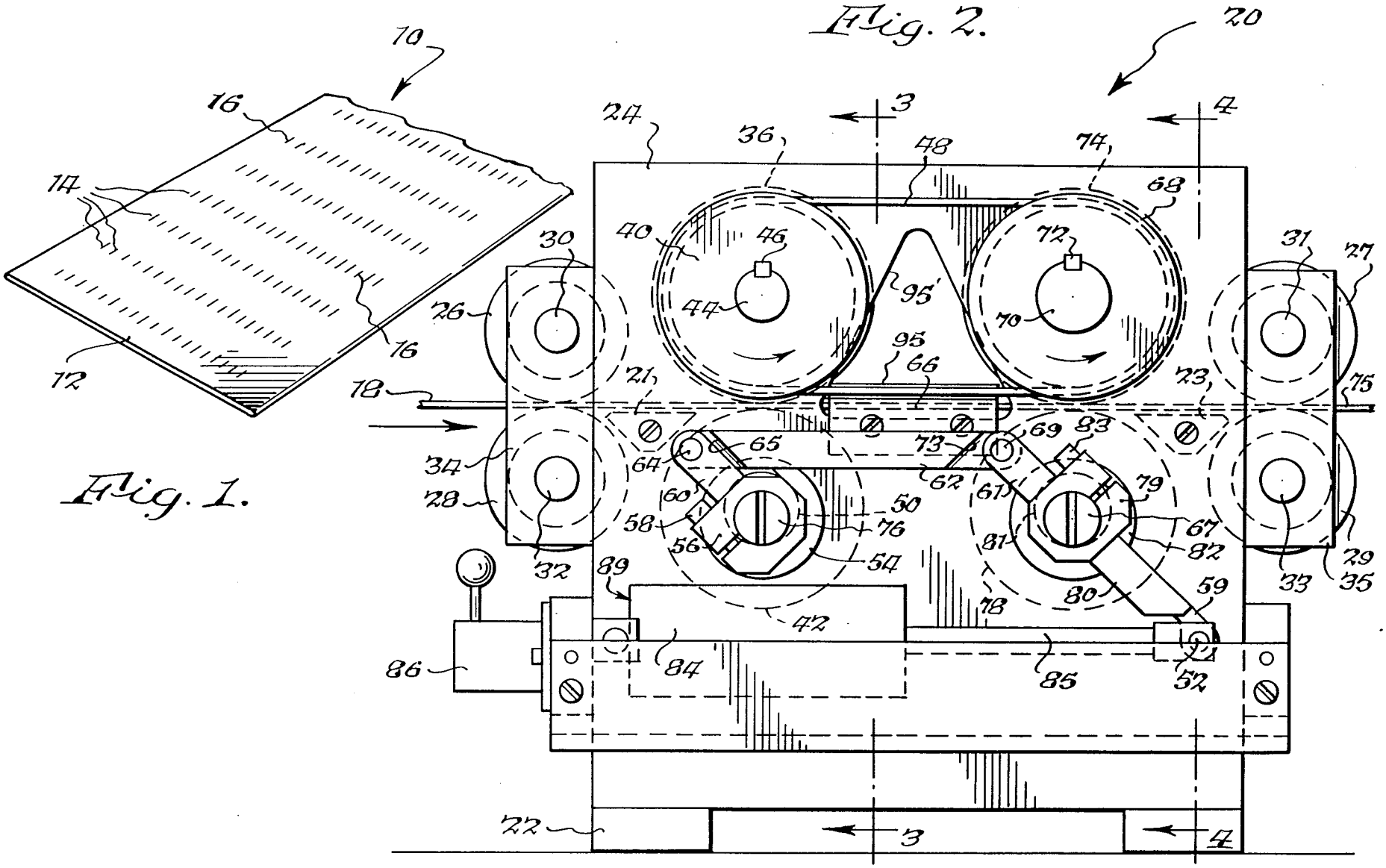
FIG. 1 is a perspective view of a segment of prestuck food casing made according to the present invention.
FIG. 2 is a side elevational view of the apparatus of the invention.

Turning first to FIG. 1, there is seen a finished prestuck film 10 made according to the present invention. In most instances the prestuck films 10 are nonedible, fibrous materials which have been formed by saturating a paper web or other cellulosic or noncellulosic manufactured fiber, etc., with viscose or other film forming polymer, which is usually regenerated in a coagulating bath, washed, plasticized and dried before presticking operations.

Although prestuck film 10 is illustrated in the form of flattened tubular material 12 the present invention also contemplates preparation of perforated materials as flat ribbon films prior to being seamed into tubular casing. Although the methods and apparatus described herein may be used in preparing nonfibrous, unreinforced food films they are especially desirable in preparing reinforced packaging films for heavier whole, chunk style and large size sausage and meat products, like whole hams, picnics and poultry products, including poultry parts, turkey rolls, deli loaves, bolognas and whenever strong, large size food casings are indicated. Especially intended are food casing films which are premoisturized and in ready-to-stuff condition with sufficient moisture content that additional soaking prior to stuffing can be eliminated before being used by food processors. In this regard, it was discovered that prestuck food films moisturized by meat processors and premoisturized food casings moistened by casing manufacturers having multiple rows of perforations 14 (FIG. 1) preferably have a plurality of slits 16 rather than conventional pin or punch style holes where, for instance, perforations are formed by removing small pieces of casing film. It was found that the longitudinal slits are especially effective in venting air from the moistened casing with statistically fewer failures due to rupturing during filling operations. Shorter, more efficient stuffing cycles are achieved with slits ranging in length from about 1 mm to about 6 mm running parallel to the longitudinal axis of the film. The longer slits are most adaptable for casings used in packaging whole meat products like hams, whereas slits of shorter length are more suitable for stuffing meat emulsions for sausage products. The slits are introduced into the film with the apparatus described herein equipped with multiple knife blades described in greater detail below.

Figure 4:
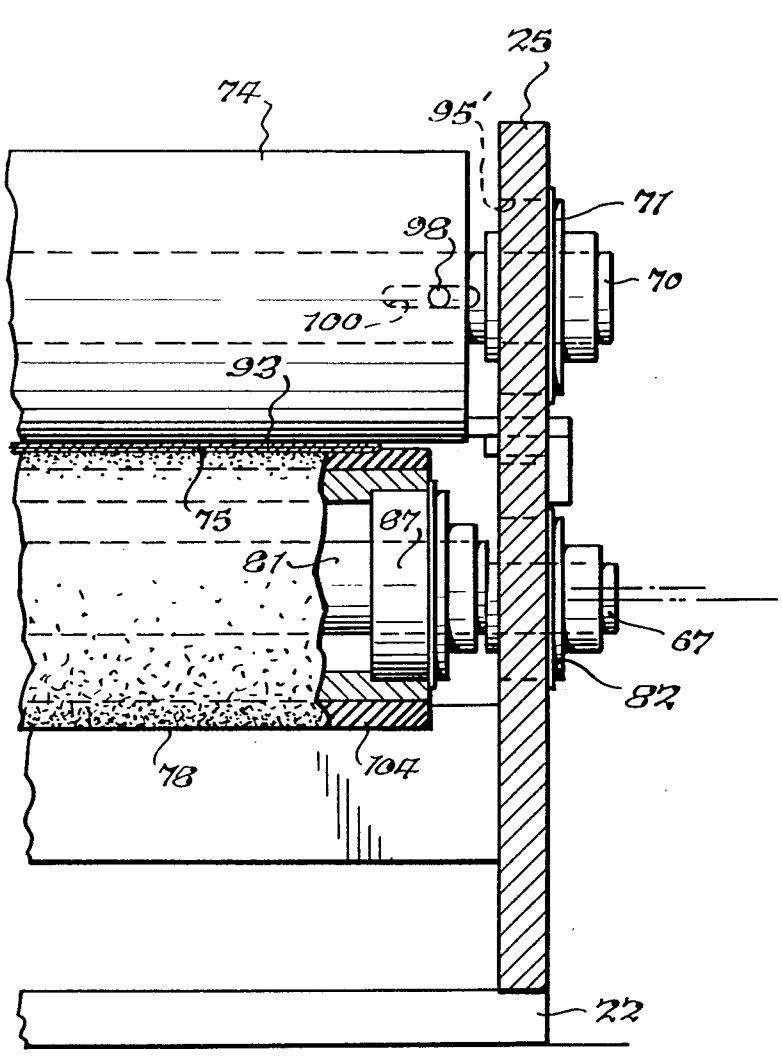
FIG. 4 is a sectional fragmentary view of the drive rolls taken along lines 4—4 of FIG. 2.
Figure 3:
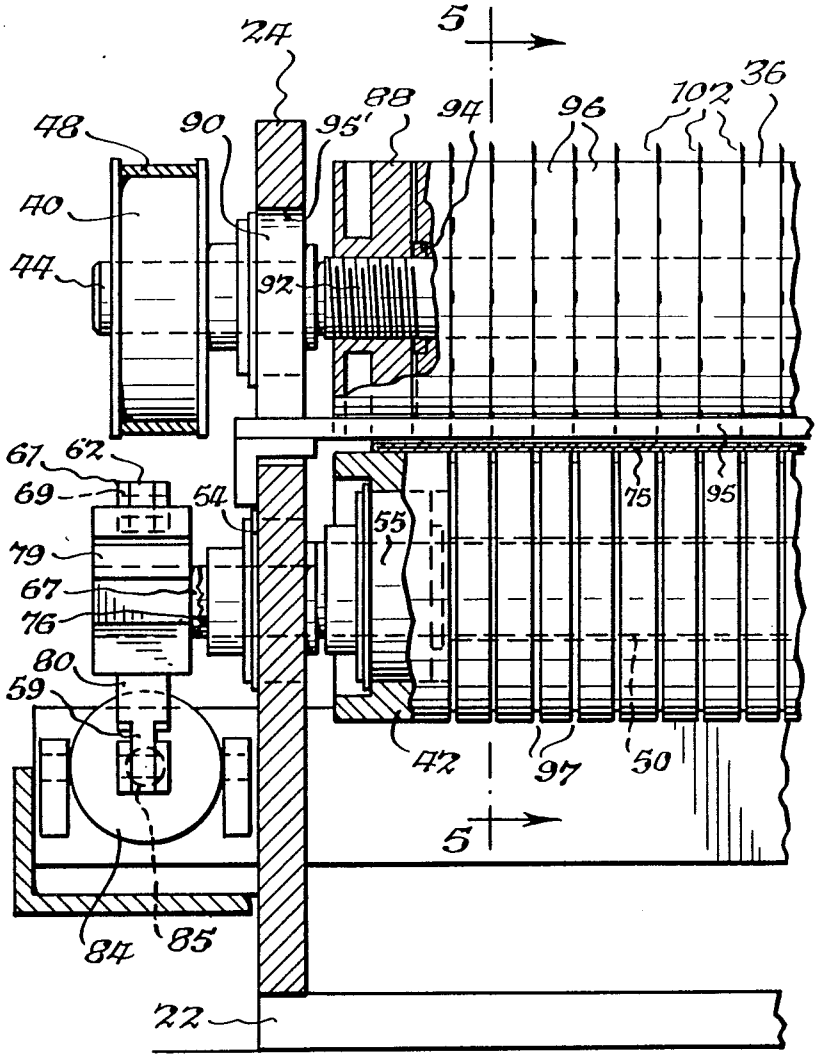
FIG. 3 is a sectional fragmentary view of the perforating roll taken along lines 3—3 of FIG. 2.

FIG. 2 illustrates presticker apparatus 20 of the present invention for making perforated casings whereby the leading end of a flattened tubular film 18 is pulled through the apparatus, for example, by a collecting reel (not shown) located downstream of the apparatus. The apparatus includes a support base 22 and outer frame members 24 and 25 having an access opening 95'. The tubular film 18 is initially threaded between a pair of guide rolls 26 and 28 supported by bracket 34 and guide roll shafts 30 and 32. FIG. 3 best illustrates a first set of rotatable rolls comprising an upper perforating roll 36 and a lower backup roll 42. The perforating roll is equipped with multiple perforating members 102 selected from spaced knife blades, punches, piercing needles, etc., projecting radially from the surface of the roll. Rolls 36 and 42 cooperate to form a nip therebetween in which the film 75 is drawn. FIG. 4 illustrates a second set of rotatable rolls comprising an upper power roll 74 and lower squeeze roll 78. Rolls 74 and 78 cooperate to form a nipping surface therebetween for passage of film 75. The second set of rolls 74 and 78 are parallel to and aligned with the first set of rolls 36 and 42. In addition, the first and second sets of rolls are linked together such that advancement of film 75 through their respective nipping surfaces engages power roll 74 causing it to rotate and simultaneously turn perforating roll 36.

To center the film during operation of the apparatus end film guides 21 and 23 (FIG. 2) are employed. A center film guide 66 (FIG. 2) positioned between the first and second sets of rolls may also be used. Guide rolls 27 and 29 (FIG. 2) positioned at the exiting end of the apparatus directing perforated film to the collection reel (not shown) are supported by bracket 35 and guide roll shafts 31 and 33.

Figure 6:
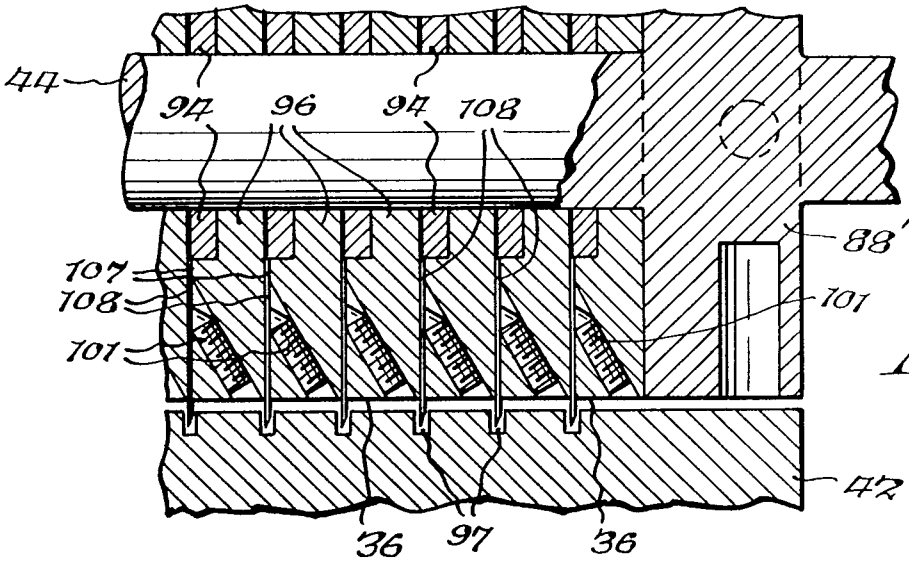
FIG. 6 is an enlarged fragmentary view of the perforating rolls taken along lines 6—6 of FIG. 5.

As best shown by FIG. 3, perforating roll 36 is mounted on shaft 44 between frame members 24 and 25. Shaft 44 and roll 36 are mounted for rotation on bearings 90 and supported by frame members 24 and 25, the shaft and roll turning when end pulley 40 keyed to slot 46 (FIG. 2) is rotated by drive belt 48 extending from power roll 74. The perforating roll 36 is preferably an assembly of separate holders 96 shaped in the form of annular discs of uniform dimension compressed into a unitary structure between nut 88 secured by threads 92 on shaft 44 (FIG. 3) and shaft shoulder 88' (FIG. 6).

Perforating roll 36 is driven by power roll 74 with the objective that the peripheral speed of the power roll and the rotating perforating members 102 radially extending from the surface of roll 36 will be the same or substantially the same. Accordingly, the workpiece 18 passing between the nips of the first and second sets of rolls provides the mechanical energy for the apparatus turning the power roll 74 which drives the perforating roll and perforating members through the film. In other words, the peripheral speed of the rotating perforating members and the linear speed of the compressed casing 93 (FIG. 4) passing between the rolls will be equal or virtually the same.

Power roll 74 like perforating roll 36 is mounted on a shaft 70 between frame members 24 and 25. Roll 74 drives shaft 70 through set screw 98 keyed to slot 100, rotating on bearings 71 when compressed casing 93 is advanced through the nip created by the roll 74 and lower squeeze roll 78. The rotation of shaft 70 also turns pulley 68 (FIG. 2) keyed through slot 72. Although drive belt 48 is shown as one means for transferring energy from power roll 74 to the perforating roll 36 it is understood that alternative means may be used, for instance, gears, including idlers in place of pulleys and drive belts to transfer energy to the perforating roll, so that the peripheral speed of the perforating roll will be equivalent to the linear speed of the workpiece passing between the rolls.

FIG. 3 also illustrates comb 95 in the form of a bar running parallel to the rolls positioned above film 75 and downstream to roll 36. Comb 95 retains the film in a flattened condition as roll 36 turns and perforating members 102 are withdrawn from the film.

The lower rolls 42 and 78 perform cooperatively with their respective upper rolls. Roll 42 (FIG. 3) serves as a backup to perforating roll 36 engaging tubular films 75 at the nip formed between said rolls compressing the film and providing a support surface for the film while the perforating members 102 pass through both surfaces of the flatten tubular material. Backup roll 42 is equipped with terminal bearings 55 at each end of the roll which roll is mounted for rotation about shaft 50, the latter of which includes eccentric terminal stub shafts 76. Roll 42 and shaft 50 are pivotally mounted through their eccentric stub shafts 76 which pass through frame members 24 and 25 and rotate on bearings 54. The surface of backup roll 42 which may be polyvinyl chloride or other suitable thermoplastic material has a series of relatively narrow parallel slots or voids 97 for receiving the perforating members 102 protruding from the surface of roll 36. The dimensions of slots 97 should be at least equal to the length and width of the perforating members entering the slots so as to avoid making contact with the backup roll. This will also extend the serviceable life expectancy of the knives, punches or needlelike elements used in perforating the film and the rolls before replacement becomes necessary. With the apparatus of the present invention cutting blades, punches, needles, etc., make contact only with workpiece 75, and therefore, the perforations are formed with greater efficiency and without tearing or fraying the film in the process.

Squeeze roll 78 (FIG. 4) operates with power roll 74 compressing film 93 as it is pulled through the apparatus. Roll 78 preferably may have outer urethane layer 104 to aid in frictional engagement of the rolls as the film advances through the apparatus. Squeeze roll 78, like backup roll 42, has terminal bearings 87 for rotation of the roll about a central shaft 81, the shaft including eccentric terminal stub shafts 67. Roll 78 and shaft 81 are pivotally mounted through eccentric stub shafts 67 which pass through frame members 24 and 25 and rotate on bearings 82.

FIG. 2 illustrates the lower rolls in nipping engagement with the flattened film. However, in order to perform the initial threading of the film through the apparatus rolls 42 and 78 may be lowered by turning their eccentric shafts 76 and 67. This may be performed by connecting terminal stub shafts 76 and 67 to disengaging and re-engaging means which generally include eccentric arms 60 and 80 (FIG. 2) and motor means 89 therefor. Eccentric arm 80 includes an upper arm 61, an extension of clamp 79, which grips eccentric terminal stub shaft 67 with the aid of locking bolt 83. The upper arm 61 is interconnected to eccentric arm 60 by tanged link 62 through linking pins 64 and 69 at narrowed sections 65 and 73. Clamp 56 and locking bolt 58 grip eccentric terminal stub shaft 76. Eccentric arm 80, including a lower arm extension 59 is connected to rod 85 of fluid cylinder 84 through linking pin 52. Cylinder 84, such as a pneumatic or hydraulic fluid powered cylinder of conventional design may be used. Actuation of the cylinder is controlled through valve 86. Thus, because of the linkage of rolls 42 and 78 through their respective eccentric arms 60 and 80 and tanged link 62 extension of rod 85 will raise the rolls in tandem to form nipping surfaces with rolls 36 and 74. That is to say, by extension of rod 85 from cylinder 84 eccentric stub shafts 76 and 67 are rotated counter clockwise thereby elevating shafts 50 and 81 and their respective rolls 42 and 78 to operating position as shown by FIG. 2 by compressing the film against perforating roll 36 and power roll 74. Similarly, by retracting rod 85 into cylinder 84 eccentric arms 60 and 80 and eccentric stub shafts 76 and 67 are rotated clockwise lowering rolls 42 and 78 from nipping engagement with rolls 36 and 74. With rod 85 retracted and rolls 42 and 78 in a lowered position film 18 can be threaded through the apparatus before commencing sticking operations.

Figure 5:
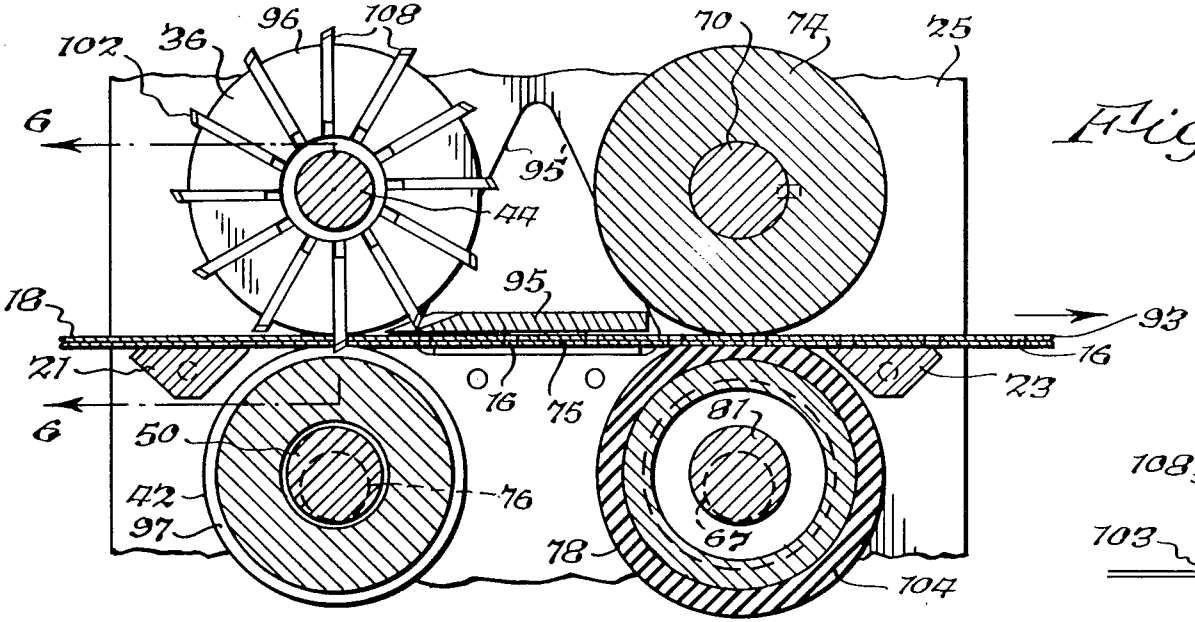
FIG. 5 is a side sectional view of the perforating and drive rolls taken along lines 5—5 of FIG. 3.

As previously indicated, perforating roll 36 includes a plurality of film perforating members 102 extending radially from the surface of the roll. The perforating members may include any film penetrating element, such as punches, needles, blades and the like. However, the present invention preferably utilizes a plurality of spaced knife blades 108 (FIG. 5) elevated and radially encircling the entire surface of perforating roll 36 with multiple rows of blades. The knife blades are positioned on the perforating roll so their respective cutting edges are parallel to the longitudinal axis of the film. By positioning the blades with their cutting edges in this direction tearing the film or expanding individual perforations is restricted. As best illustrated by FIG. 6, individual blades 108 are inserted between holders 96 with inner terminal ends 107 in abutting relationship with blade stop rings 94 restricting inward movement of the blades. The blades are locked into position by set screws 101. Knife blades 108 are of sufficient length as to protrude from the surface of roll 36 and enter slits 97 in backup roll 42, but without making contact with the inner surfaces of the slits.

Although the knife blades 108 of the present invention may have a cutting edge which is substantially square or chisel shaped the cutting edge is preferably beveled or tapered such that when installed on the perforating roll knife edge 103 will extend further from the surface of the roll than knife edge 109. In addition, the cross section of blade 108 in region 106 of the cutting edge is preferably narrowed on both sides of the blade to form a sharp film slitting edge.

Figure 7:
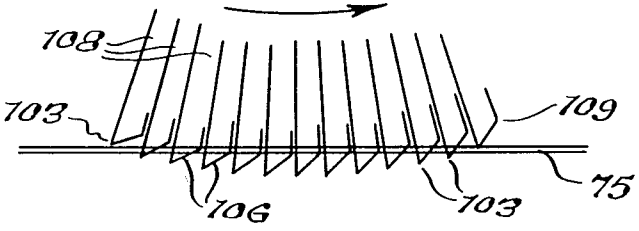
FIG. 7 is a diagramatic view of the path of an arcing knife blade entering and exiting flattened tubular casing.
Figure 9:
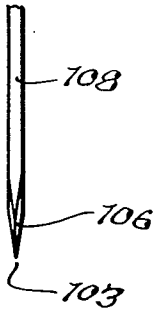
FIG. 9 is an enlarged edge view of the cutting blade illustrated in FIG. 8.
Figure 8:
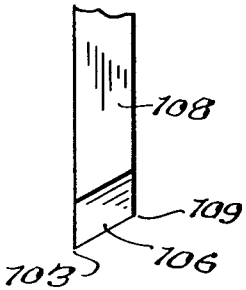
FIG. 8 is an enlarged side view of a preferred cutting blade of the present invention.

FIG. 7 simulates diagramatically the arcing movement of a single knife blade 108 through tubular casing film 75. The cutting edge is positioned to permit the trailing end of cutting edge 103, the point furthest from the surface or axis of the roll (not shown) to make an initial puncture of the film. The cutting edge of the knife then penetrates further into the film by a slitting action until the entire cutting edge has penetrated through both film surfaces. As the blade 108 continues its arcing path the shortest point 109 on the tapered cutting edge which is the leading edge of the blade exits the perforation first without tearing or expanding the film followed finally by longer trailing edge 103. Accordingly, the beveled cutting edge of the knife is positioned parallel to the longitudinal axis of the film whereby the longer trailing edge of the knife enters the film first and exits the film last on rotation of the blades. This cutting action operates to prevent or limit formation of oversized perforations and perforations which are prone to lead to ruptured casings during filling operations.

Although the invention has been described in considerable detail with respect to the preferred embodiments thereof, it will be apparent that the invention is capable of numerous modifications and variations to those skilled in the art without departing from spirit and scope of the invention, as defined in the appended claims.

What is claimed is:

1. A method of forming multiple perforations in food casing film, which comprises the steps of providing a first set of rotatable rolls and a second set of rotatable rolls, the first set of rolls comprising a perforating roll and a backup roll cooperating with the perforating roll forming a nip therebetween, said perforating roll having means for making multiple perforations in the film, the second set of rolls comprising at least one power roll and a cooperating roll forming a nip therebetween, said second set of rolls arranged parallel to the first set of rolls and linked thereto such that rotation of the perforating roll is controlled by rotation of the power roll, said method including the steps of engaging the film at the nips of the first and second sets of rolls, and advancing the film to rotate the power roll and turn the perforating roll to perforate the film.

2. The method of claim 1 including the step of controlling the peripheral speed of the rotating perforating roll to correspond substantially to the peripheral speed of the rotating power roll.

3. The method of claim 2 wherein the backup roll includes complimentary voids on the surface of the roll for receiving the perforating means after passing through the film.

4. The method of claim 3 wherein the perforating roll is equipped with a plurality of knife blades.

5. The method of claim 3 wherein the perforating roll is equipped with a plurality of spaced knife blades projecting radially from the surface of the roll, each of said blades having a cutting edge positioned parallel to the longitudinal axis of the film.

6. The method of claim 5 wherein the knife blades on the perforating roll are arranged such that on rotation of such roll the trailing end of the cutting edge enters the film first and exits the film last.

7. A prestuck food casing made according to the method of claim 1.

8. A prestuck food casing made according to the method of claim 4.

9. A prestuck food casing made according to the method of claim 5.

10. The method of claim 3 wherein the perforating roll is equipped with a plurality of punches.

11. The method of claim 3 wherein the perforating roll is equipped with a plurality of piercing needles.

12. A method of forming multiple perforations in food casing film with minimal tearing of the film or expansion in size of the perforations, which comprises the steps of providing a plurality of knife blades for rotation about a fixed axis, actuation of said knife blades being controlled by rotating drive means separate from the knife blades, engaging the knife blades and drive means with the film, and advancing the film for causing the drive means to rotate the blades and the blades to perforate said film while controlling the peripheral speed of the blades to substantially correspond to the linear speed of the film.

13. The method of claim 12 wherein the knife blades perforate the film without perforating a cooperating backup roll.

14. The method of claim 13 wherein the knife blades have a cutting edge positioned parallel to the longitudinal axis of film, the trailing edge of said cutting edge entering the film first and exiting film last on rotation of said blades.

15. A prestuck food casing made according to the method of claim 12.

16. The prestuck food casing of claim 15 which is a fibrous casing.

17. The prestuck food casing of claim 16 which is a premoisturized casing.

18. An apparatus for perforating food casing film with minimal tearing of the film or expansion in the size of perforations, which comprises a set of rotatable rolls comprising a perforating roll and a backup roll cooperating with each other for forming a nip therebetween, said perforating roll having multiple means for perforating said film, said backup roll including a complementary arrangement of surface voids to receive the perforating means without perforating the backup roll, power roll means for rotating the perforating roll, means for linking the power roll means and the perforating roll, and means for engaging the film with the power roll means and the rotatable rolls so that the power roll means is driven by the film when the film is advanced.

19. The apparatus of claim 18 wherein the perforating means comprises multiple spaced knife blades.

20. The apparatus of claim 18 wherein the power roll means for rotating the perforating roll includes a cooperating squeeze roll forming a nip therewith.

21. The apparatus of claim 20 wherein said means for linking the power roll and the perforating roll turns the perforating roll at a peripheral speed which is substantially the same as the linear speed of the film passing through the apparatus.

22. An apparatus for perforating a food casing film with minimal tearing of the film or expansion in the size of perforations, which comprises a first set of rotatable rolls, a second set of rotatable rolls and means for linking the first and second sets of rotatable rolls for rotation with each other, the first set of rolls comprising a perforating roll and a backup roll cooperating with the perforating roll forming a nip therewith, film perforating means attached to said perforating roll, the second set of rolls comprising at least one power roll and a cooperating roll forming a nip therewith, means for engaging the second set of rolls with the film so that by advancement of the film through the nip of the second set of rolls the power roll is driven by the film.

23. The apparatus of claim 22 wherein the backup roll of the first set of rolls includes a complimentary arrangement of voids on the surface of said roll to receive the film perforating means after passing through said film.

24. The apparatus of claim 23 wherein the film perforating means comprises a plurality of spaced blades.

25. The apparatus of claim 23 wherein the film perforating means comprises a plurality of spaced knife blades projecting radially from the surface of the perforating roll.

26. The apparatus of claim 23 wherein the film perforating means comprises a plurality of spaced punches.

27. The apparatus of claim 23 wherein the film perforating means comprises a plurality of spaced piercing needles.

28. The apparatus of claim 25 wherein each of the knife blades has a cutting edge positioned parallel to the longitudinal axis of the film.

29. The apparatus of claim 24 including means for disengaging and re-engaging the first and second sets of rolls to form nipping surfaces therebetween.

30. The apparatus of claim 29 wherein the disengaging and re-engaging means comprises eccentric shafts mounted through each central axis of the backup roll of the first set of rolls and the cooperating roll of the second set of rolls, at least one end of each of said shafts being linked to shaft pivoting means.

31. The apparatus of claim 30 wherein the shaft pivoting means comprises interconnected clamping means for engaging the eccentric shafts to simultaneously disengage and re-engage the backup roll with the perforating roll and the cooperating roll with the power roll, said shaft pivoting means including motor means for pivoting the shafts.

* * * * *